United States Patent [19]

Dolnick et al.

[11] Patent Number: 4,778,378

[45] Date of Patent: Oct. 18, 1988

[54] SELF-POWERED INTERMITTENT IGNITION AND CONTROL SYSTEM FOR GAS COMBUSTION APPLIANCES

[75] Inventors: Earl M. Dolnick, Encinitas; Mark K. Goldstein, La Jolla, both of Calif.

[73] Assignee: Quantum Group, Inc., San Diego, Calif.

[21] Appl. No.: 937,609

[22] Filed: Dec. 3, 1986

[51] Int. Cl.[4] ..... F23N 5/08

[52] U.S. Cl. ..... 431/79; 431/46; 431/51; 250/554; 136/253; 137/65

[58] Field of Search ..... 431/46, 51, 53, 54, 431/20, 79, 50, 60; 136/291, 246, 253; 137/65; 340/578; 323/906; 250/554

[56] References Cited

U.S. PATENT DOCUMENTS

| | | | |
|---|---|---|---|
| 2,306,073 | 12/1942 | Metcalf | 431/51 |
| 2,698,140 | 12/1954 | Buehler | 431/20 |
| 2,919,858 | 1/1960 | Matthews | 431/50 |
| 3,174,535 | 3/1965 | Weber | 158/125 |
| 3,704,980 | 12/1972 | Lokkart | 431/53 |
| 3,751,303 | 8/1973 | Kittl | 136/253 X |
| 3,765,820 | 10/1973 | Ito et al. | 431/79 |
| 4,090,359 | 5/1978 | Doellner | 136/246 |
| 4,131,413 | 12/1978 | Ryno | 431/51 |

FOREIGN PATENT DOCUMENTS

| | | | |
|---|---|---|---|
| 355118 | 8/1961 | Switzerland | 250/554 |

*Primary Examiner*—Samuel Scott
*Assistant Examiner*—Noah Kamen
*Attorney, Agent, or Firm*—Christie, Parker & Hale

[57] ABSTRACT

A self-powered control system for a gas-fired appliance having a pilot burner and a main burner includes an emissive surface in the flame of the pilot burner and a photovoltaic device for irradiation from the emissive surface for providing electrical power for the control system. Two normally closed electromagnetic latching valves are arranged in series between a source of fuel gas and the main burner with a connection to the pilot burner between the two valves. The first valve is latched open when the photovoltaic device is irradiated by the emissive surface and is unlatched to close when the device is not so irradiated. The second valve is unlatched to close when the main burner is not burning. A double acting solenoid or the like is used for sequentially opening the first and second valves for lighting the pilot and main burners. A safe, reliable control system is thereby provided without external electrical power. Similar principles are used for powering a safety flue damper and air flow fan.

12 Claims, 5 Drawing Sheets

SELF-POWERED INTERMITTENT IGNITION AND CONTROL SYSTEM FOR GAS COMBUSTION APPLIANCES

BACKGROUND OF THE INVENTION

The fuel gas powered heat producing device is among the most common of appliances. A fuel gas, typically natural gas, propane or butane is ignited and burns within a combustion chamber. The resultant heat is used to heat water or air, or for a wide variety of industrial process applications. Millions of such devices are found throughout the world. Problems associated with the use of these devices include the generation of toxic combustion products if the fuel is improperly burned. Since the fuel gas is combustible, any leakage brings with it the hazards of fire or explosion.

In most places, safety systems to monitor the combustion process and to terminate the flow of fuel gas if a fault occurs are mandated by law. The vast majority of these heating devices contain a pilot burner which is in continuous operation. This "standing pilot" provides a source of ignition whenever fuel gas enters the main burner. A thermoelectric device, typically a thermocouple, is placed in the pilot flame and the resultant electric current produced operates an electromagnet in the fuel valve which holds it open and allows fuel gas to flow to the main burner. If the pilot flame fails for any reason, the thermocouple slowly cools and stops producing electric power, releasing the electromagnet which causes the valve to close.

Thus, the standing pilot thermoelectric system is totally self-powered. The main disadvantage of this system is its slow response. As much as 3 minutes may pass after the pilot flame failure before closure of the valve takes place. For larger burners, any delay in operation of the safety circuit would mean that a considerable volume of unburned fuel gas could flow before the valve closes. This can lead to fire or explosion. For this reason, larger burners utilize electronic flame sensors which have much faster response times. One example of a widely used electronic device is the flame rectifier. These devices, although capable of shutting off the flow of fuel within four seconds, require enough electric power that connection to the A.C. power line is required. As a consequence of the A.C. power requirement, to be safe, the control must be designed to shut off the appliance in the event of A.C. line failure.

Another device for this purpose is the subject of U.S. patent application Ser. No. 659,074 filed Oct. 5, 1984 which is a continuation in part of U.S. patent application No. 517,699 filed Jul. 25, 1983. The subject matter of these applications is hereby incorporated by reference. It teaches the use of an emissive element placed within the pilot flame and a photovoltaic cell to convert the resultant radiation to electric power which is used to operate the safety electromagnet in the gas valve. Its speed of operation is faster than the flame rectifier yet, like the much slower thermocouple driven systems, it is entirely self-powered.

Many heating devices have automatic controls for the regulation of temperature. In the simplest of these devices, such as the type found on the typical storage type water heater, the fuel valve is controlled by a thermomechanical operator which senses the tank temperature. The contraction and expansion of the operator controls the valve directly. Such controls are simple and self-powered but allow temperature measurement at only one point in the tank. Because of consideration of the location of the fuel supply pipe, the control is usually placed in the vicinity of the burner, near the bottom of the tank. As a consequence of the low placement of a single temperature measurement point and under certain patterns of use, an overheating condition called stacking may occur. If the temperature control were done with electronic devices, the temperature at multiple points in the tank could be sensed, thus eliminating this problem.

In other types of devices, such as space heaters, remote sensing of the temperature is necessary, since the sensing point may be some distance from the burner. Some form of electronic control is usually used. Although thermopile operated valves are capable of operating with remote thermostats, they require standing pilots in order to provide the power for valve operation. Some heaters utilize mechanical or hydraulic thermostats which directly control the valve. Most other systems employ electric thermostats in conjunction with valves powered by the A.C. line.

In recent years, as the energy crisis produced a dramatic rise in the price of fuel gas, many gas appliances were redesigned in order to increase their operating efficiency. Standing pilots were replaced with intermittently operating ones with electrically operated ignitors. Thermostats were replaced with clock controlled automatic setback types. Automatically operated vent dampers were added to trap warm air within the combustion area when the flame was not present. Unfortunately, all these devices require the appliance to be connected to the A.C. power line which meant that A.C. power must be available in the vicinity of the appliance, and, even though ample fuel gas is available, the heating system will not work in the absence of A.C. power. This represents a real hazard for residential heating in winter, since A.C. line failure due to severe weather conditions does occur.

There is a need for a system for use with combustion appliances which provides the efficiency improvements described above but would derive all power needed from the flame itself, without any requirement for outside electric power. This invention pertains to just such a system for powering the fuel control valve, thermostat, electric ignitor, flue damper and, if desired, an air circulating fan, with all power being derived entirely from the flame.

A basis for this system is the invention as described in the patent application mentioned above. An emissive element is placed within a flame, and the resultant radiation strikes a photovoltaic cell which produces electric power. The emissive element may be either a metallic screen or mesh which radiates in the manner of a black body in the flame, or it may be a quantum stimulated emitter which radiates at specific wavelengths. The photovoltaic cell may be an array of photovoltaic cells made of Silicon or Copper Indium Diselenide or other photovoltaic material. The photovoltaic cell may be designed such that a potential of several volts is generated. This may be used to recharge a rechargeable battery which may assist in operations such as valve opening and ignition which must be accomplished before the flame is present. With properly designed components, power from the battery is needed only transiently, allowing ample time for battery recharging. Thus, the invention not only provides fast flame failure detection but also acts as the power source so that the control system may be completely self powered.

It is possible to utilize thermoelectric devices for some of the functions. Self-powered ignition systems have been described by Weber, U.S. Pat. No. 3,174,535 and Ryno, U.S. Pat. No. 4,181,413. Both of these utilize thermopiles as the source of electric power. Since the electric potential generated by a thermopile is low, multiple devices are needed. Each thermopile is itself an assembly of many thermocouples. Hence, they are expensive to fabricate. Since they have a very large thermal mass, their output is considerably delayed after burner ignition, and power continues to be produced long after the flame is extinguished. Thus, they are not suitable for the dual functions of power production and flame sensing.

In order to accomplish the task of making a comprehensive selfpowered safety, ignition, and control system for combustion appliances, specially modified components must be employed. They must be arranged so as to minimize the electric power needed. In particular, the fuel valve must be of a type which needs power only to open, and once open, requires no further power from the battery. Such a design is the double latched valve herein described.

In a typical standing pilot gas valve, the first stage valve is latched in the open position by a thermocoupled powered safety magnet and an electrically powered solenoid is used to open the second stage. No means is provided to latch open the second stage, so the solenoid must be continuously energized. Considerable power is needed to keep the valve open. Valves designed for intermittent ignition service are not latched at all and therefore the operators for both stages necessarily consume electric power. Thus, all present intermittent ignition systems are powered by the A.C. line.

BRIEF SUMMARY OF THE INVENTION

There is, therefore, provided in practic eof this invention a self-powered control system for a gas-fired appliance having a pilot burner and a main burner. Two electromagnetic latching valves are provided in series between a source of fuel gas and the main burner with a connection to the pilot burner between the two valves. Power for initial ignition and valve operation comes from a rechargeable battery and the power to recharge the battery is provided by an emissive surface in the flame of the pilot burner and a photovoltaic device exposed in radiation from the emissive surface. The first valve is closed when the photovoltaic device is not irradiated by the emissive surface and the second valve is closed when the main burner is not burning. The first and second valves can be successively opened for igniting the pilot and main burner. Such an arrangement provides for rapid shut off of both pilot and main burners in the event the pilot light is extinguished. Control of the second valve can be by either a photovoltaic device or a thermopile since less rapid response is required in the second stage of such a two-stage valving system.

DRAWINGS

These and other features and advantages of the present invention will be appreciated as the same becomes better understood by reference to the following detailed description when considered in connection with the accompanying drawings wherein.

DESCRIPTION OF THE INVENTION

In the present invention, the concept of a magnetic latch is extended to holding open the second stage valve. Power to operate the latch comes from either a photovoltaic cell array with the emissive element placed in a portion of the main burner, or a thermopile placed in the main burner.

Figure 1:
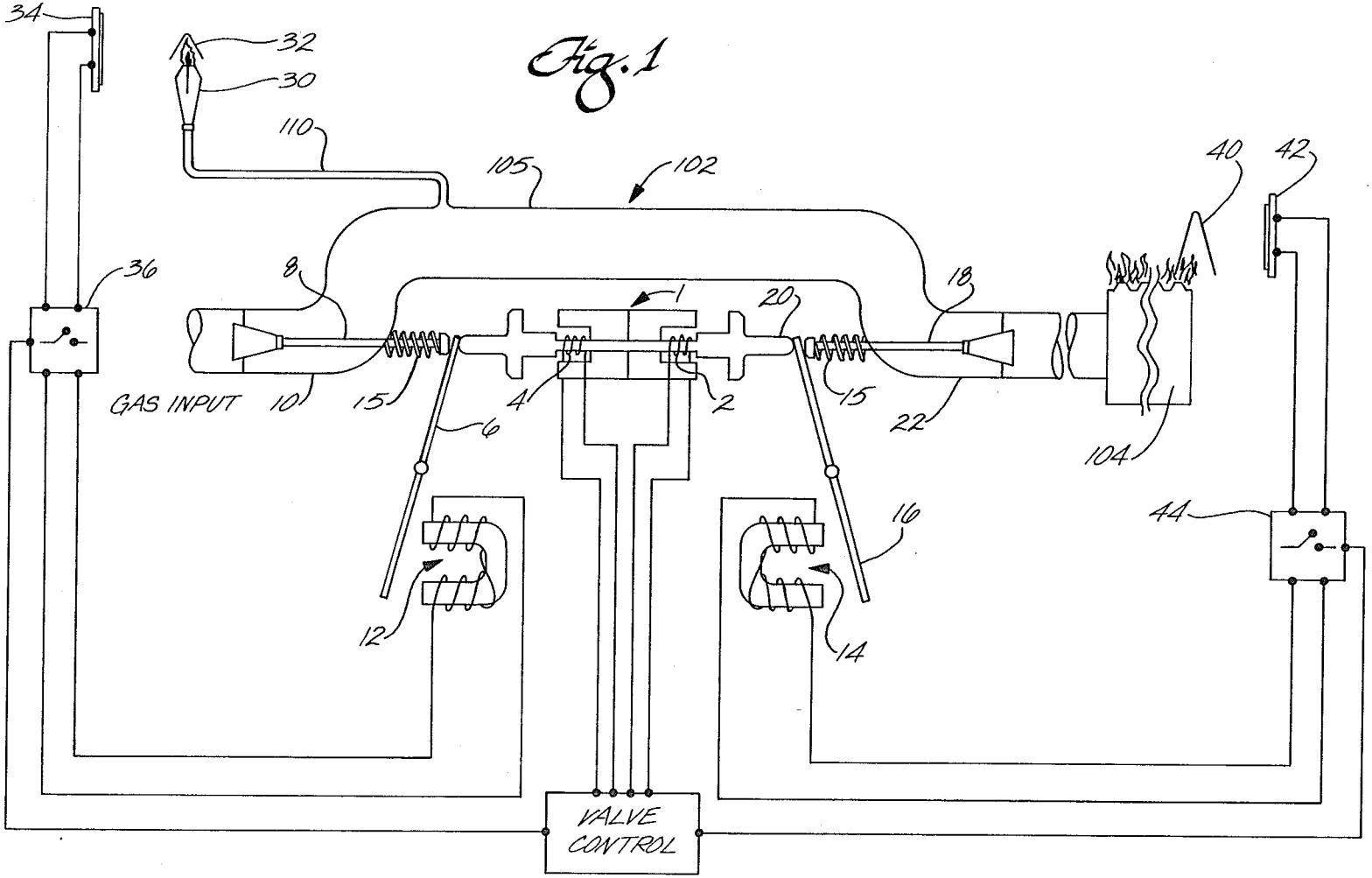
FIG. 1 illustrates semi-schematically a self-powered control system constructed according to principles of this invention.

A drawing of a valve utilizing the double latch concept is shown in FIG. 1. Two solenoids 1 mounted back to back are utilized as a bidirectional solenoid with two coils. Each coil controls motion in one direction. When power is directed to the coil 2, of one of the solenoids, the armature 20 moves to the left and presses on a pilot lever 6 which presses on a valve shaft 8, thus opening the first stage valve 10. Gas now flows to a pilot burner 30 via the gas pipes 105 and 110. A conventional ignitor, not shown, lights the gas and the resultant flame heats an emissive element 32 producing radiation. Some of the radiation strikes the photovoltaic array 34 which produces electric current. This current flows through a switch 36 to the coil of a safety magnet 12. When pushed by the armature 20, the pilot lever 6 rotates so that its lower portion contacts the pole faces of a safety magnet 12. Since the safety magnet 12 is energized by the current from the photovoltaic array 34, it holds the pilot lever 6 is position by magnetic attraction, thus keeping the first stage valve 10 in the open position.

Next, power is removed from the coil 2 and applied to the second solenoid coil 4. The armature 20 now moves in the opposite direction and presses on burner lever 16 which presses on a second stage valve shaft 18, opening the main burner valve 22. Gas now flows to the main burner 104 where it is ignited by the pilot flame. An emissive element 40 placed in part of the flame of the main burner heats and radiates in the same manner as the emissive element 32 in the pilot flame. Likewise, current produced by a photovoltaic array 42 exposed to the main emissive element 40, flows through a switch 44 to the coil of a second safety magnet 14. The burner lever 16, moving in the same manner as pilot lever 6, contacts the pole faces of safety magnet 14 and is held by magnetic attraction which holds open the second stage main burner valve 22. Both stages of the valve are biased toward the closed position by springs 15.

Power can then be removed from the solenoids and both stages of the valve will remain open. Each stage is held open by either the pilot or main burner flames. If either of the flames should fail, then its respective latch would be released, allowing that stage of the valve to be closed by the respective spring 15. Further, if the pilot fails, then, since the entire gas supply flows through the first stage valve 10, the complete gas supply would be terminated. While the valves are latched open, no power is needed by the valve other than that produced by the photovoltaic device. For ease of control, either valve may be easily closed by operating the switch 36 or 44, located in each photovoltaic circuit. These switches can be mechanical or electronic in the form of optoisolators.

The double latching concept is not limited to operation with hidirectional solenoids. It may also be used with almost any other valve configuration. An example of a type of valve that is adaptable to this concept is a servo valve in which the fuel gas pressure assists in opening and closing the valve. This valve was originally developed for use in thermopile powered systems. The valve is characterized by having a greatly reduced electrical energy requirement for the operating coil, making it possible to power the safety magnet and operate the second stage from a single thermopile. A fuel control system utilizing two of these servo valves suitably modified is demonstrated in FIG. 2.

Figure 2:
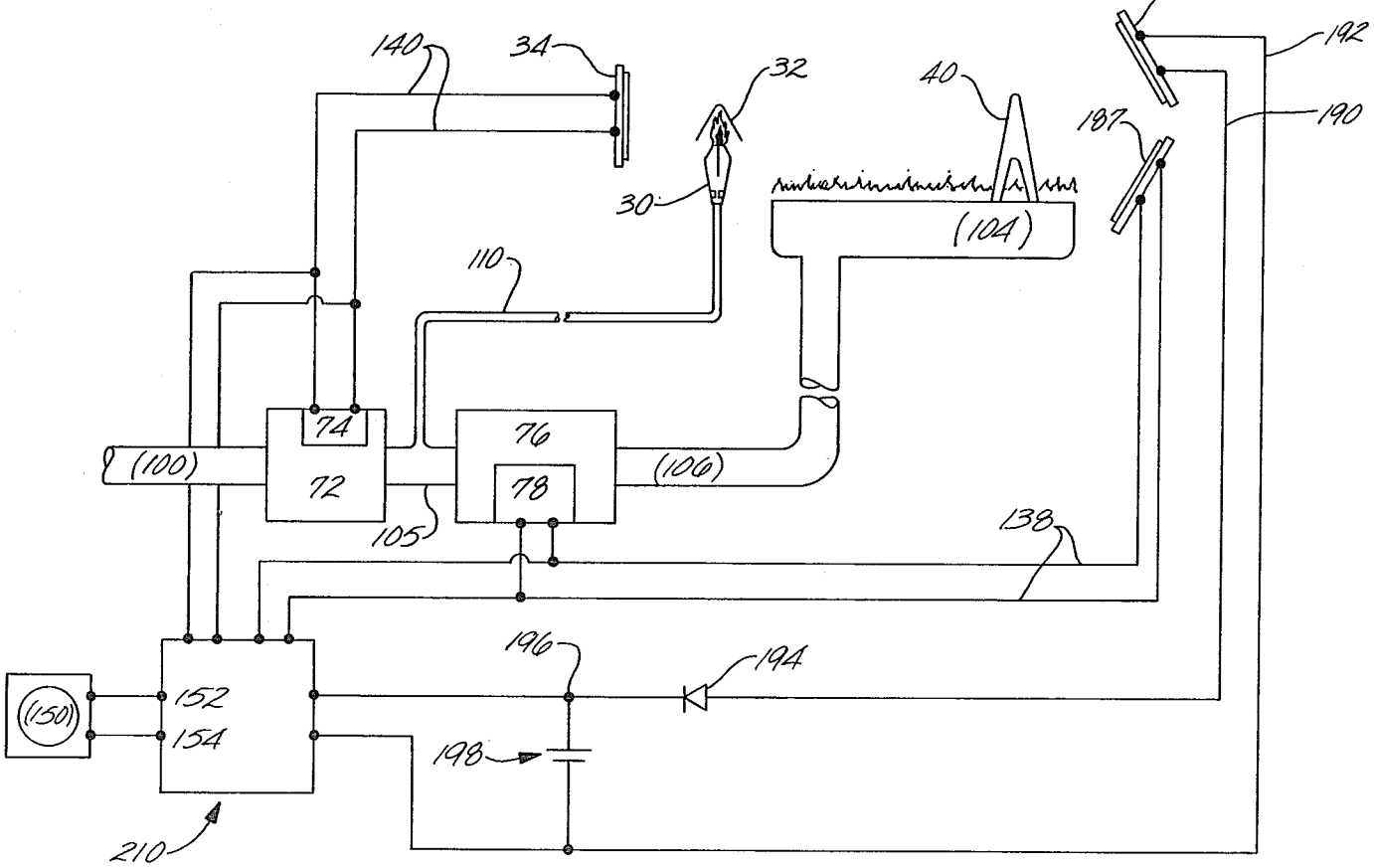
FIG. 2 illustrates schematically another embodiment of a self-powered control system.

In FIG. 2, there is shown a gas input pipe 100 connected to the first stage servo gas valve 72 containing an electromagnetic operator 74. A gas pipe 105 connects the output of the first stage gas valve 72 with the input of the second stage gas valve 76 containing an electromagnetic operator 78. Also connected to the gas pipe 105 is one end of the gas pipe 110. The other end of the gas pipe 110 is connected to the pilot burner 30. An emissive element 32 is placed just above the pilot burner 30 such that the burner flame will heat the emissive element 32 to incandescence. The output of the second stage gas valve 76 is connected via the gas pipe 106 to the main burner 104. Mounted on the main burner 104 is the emissive element 40, placed so that the main burner flame will heat the emissive element 40 to incandescence. The photovoltaic array 34 is placed such that it can intercept some of the light from the emissive element 32. Similarly the photovoltaic arrays 187 and 188 are placed such that some of the light from the emissive element 40 can strike each of them. The output conductors 140 of the photovoltaic array 34 are connected to the electromagnetic operator 74 of the first stage gas valve 72 and to the control circuit 210. In a similar manner, the output conductors 138 of the photovoltaic array 187 are connected to the electromagnetic operator 78 of the second stage gas valve 76 and to the control circuit 210. The positive output conductor 190 of the photovoltaic array 188 is connected to the anode of the isolating diode 194. The cathode of isolating diode 194 is connected via the conductor 196 to the positive terminal of battery 198 and to the control circuit 210. The negative output conductor 192 of the photovoltaic array 188 is connected to the negative terminal of battery 198 and to the control circuit 210. The conductors 152 and 154 connect the control circuit 210 to the thermostat 150. The circuit works in the following manner:

The thermostat 150 requests heat by connecting the conductors 152 and 154 together. When this happens, the control circuit 210 responds by directing some of the energy stored in the battery 198 to the electromagnetic operator 74 of the first stage gas valve 72, opening the valve and allowing gas to flow to the pilot burner 30 via the gas pipes 105 and 110. At the same time, the control circuit 210 also provides some of the battery power to a spark ignitor circuit (not shown) which ignites the gas issuing from the pilot burner 30. The resultant flame heats emissive element 32 which begins to glow. Some of the light thus produced strikes the photovoltaic array 34 which begins producing electric power. This power flows through the conductors 140 to the electromagnet 74 of the first stage gas valve 72, and begins to take over from the battery power. When the control circuit 210 has sensed that the battery is no longer needed, the battery is disconnected from the electromagnetic operator 74 and the spark ignitor circuit (not shown). The first stage gas valve 72 is now held open by the electric power produced by the photovoltaic array 34. The control circuit now directs some of the battery power to the electromagnetic operator 78 of the second stage gas valve 76, causing it to open. Gas is now admitted via the gas pipe 106 to the main burner 104 where it is ignited by the flame from the pilot burner 30. The emissive element 40 in the main burner flame begins to glow and to and illuminate the photovoltaic panels 187 and 188. In exactly the same manner as the first stage valve, the electric energy produced by the photovoltaic panel 187 takes over from the battery and holds open the second stage valve 76. The control circuit has now disconnected all loads from the battery except for a very small idling current of the control circuit itself. The electric power produced by the photovoltaic array 188 now flows via the conductors 190 and 192 and the isolating diode 194 to the battery 198 and recharging of the battery 198 begins. The control circuit 210 turns off the burner by momentarily shorting the conductors 140 together. This removes the current from the electromagnetic operator of the first stage gas valve 72 and it closes, shutting off the flow of gas. The battery provides the startup power needed and then is recharged after the burner ignites. Photovoltaic arrays are very suitable for this type of circuit because they operate at much higher voltages than thermoelectric devices, making it much easier to utilize electronics and batteries. They also provide the fast response of flame failure that is needed for safe electronic control for gas fueled devices. Electromagnetic operators designed for thermopile operation may be easily modified for the above described use by rewinding the operator coils to allow operation at lower currents and higher voltages. In order to operate the valve in the intermittent ignition mode, the manually operated safety magnet is not used. Instead, because of the good current sensitivity of the operating coil, it can be used as both the operating and latching coil.

In all cases, both stages of the valve are held open by means of electromagnetic latches powered by electric power derived from the flame. Thus, other than the power initially needed to open the valve, no external power is needed for the valve during operation.

Another mode of operation is to use the photovoltaic power supply for the pilot and the first stage valve, but use a thermopile or thermocouple to provide the power for the second stage valve. This has the advantage that, if a thermopile type servo valve were used for stage 2, no modification would be necessary. Since the first stage valve is powered by a photovoltaic system which functions as a fast flame failure detector, quick response of the thermocouple powering the second stage is not required.

Figure 3:
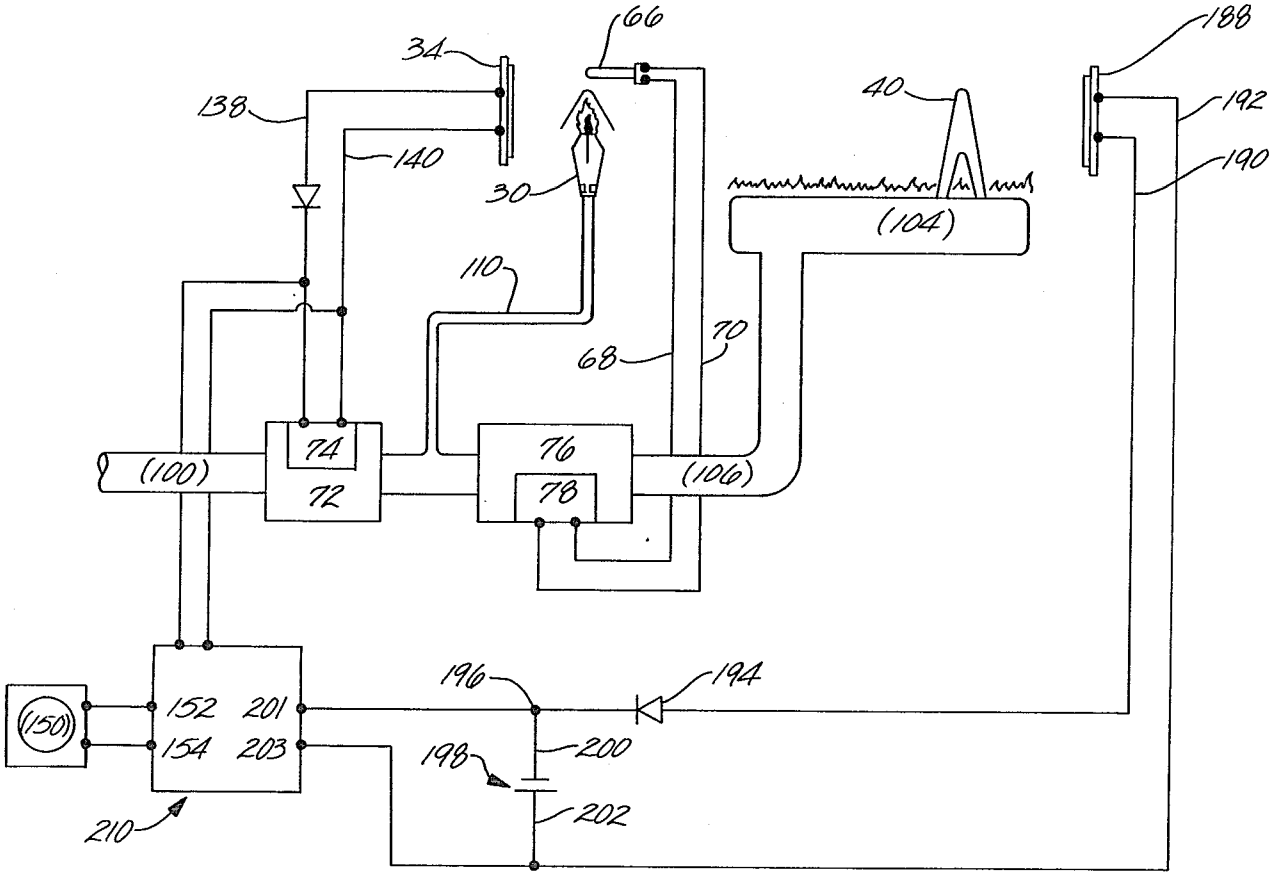
FIG. 3 illustrates schematically another embodiment of control system somewhat similar to the system illustrated in FIG. 2.

FIG. 3 illustrates a modification of the embodiment of FIG. 2 showing the combined photovoltaic/thermopile system. Operation is the same as FIG. 2 except that the photovoltaic array 187 and conductors 138 have been eliminated. A thermopile 66 is placed in the pilot burner flame. Conductors 68 and 70 connect thermopile 66 to the electromagnetic valve operator 78 of a servo valve 76. When the pilot is ignited, the power produced by the thermopile 66 directly operates the second stage valve 76. When the control circuit 210 terminates the pilot, the first stage valve 72 closes immediately, thus cutting off all gas flow. The second stage valve 76 may not close for some time because of the long thermal time constant of the thermopile, but since the first stage valve 72 has stopped all flow of gas, the delay is of no consequence.

A common type of presently available two stage electric valve is the combination solenoid/servo valve. In this design, the first stage is directly operated by a conventional solenoid and the second stage is a servo type, operated by a small coil. As described above, the servo operator is a very low power device and may be operated by a photovoltaic device or a thermopile. However, the first stage solenoid consumes considerable power and is usually line powered. The valve can be modified for use in the self-powered system simply by installing a latching safety magnet in the first stage and by redesigning the solenoid for higher efficiency and for battery operation. The latching magnet in the first stage is powered by the photovoltaic array illuminated by the emissive element in the pilot flame. Thus, the first stage solenoid is only operated during the ignition phase. Once the pilot flame is present and the first stage latch is energized, power is removed from the solenoid and recharging of the battery begins.

The system described above is essentially a first stage valve as described in FIG. 1 and a second stage valve as described in FIG. 2. The principal advantage of such a system is that valves currently in production may be easily modified to utilize this invention so that the benefits of the self powered ignition and control system may be quickly obtained.

Another device which may be redesigned for self-powered use is the flue damper. For the proper operation of combustion appliances, means must be provided for the safe venting of the toxic products of combustion of the fuel. These means usually consist of a pipe called the flue placed above the combustion chamber and extending upward a safe distance. Unfortunately, after the combustion process ceases, warm air remaining in the combustion chamber also rises up the flue. Thus, the heat contained in this air is lost. One method for increasing the efficiency of such appliances is to block the flue and open it only during the combustion period. Such a blocking device is known as a flue damper. For maximum safety, the damper must be opened and proved to be so, prior to the commencement of combustion. Systems which operate the damper by means of the combustion heat acting upon a piston chamber filled with a low boiling point liquid are not as safe since the damper can not open until after the combustion process begins.

Figure 4:
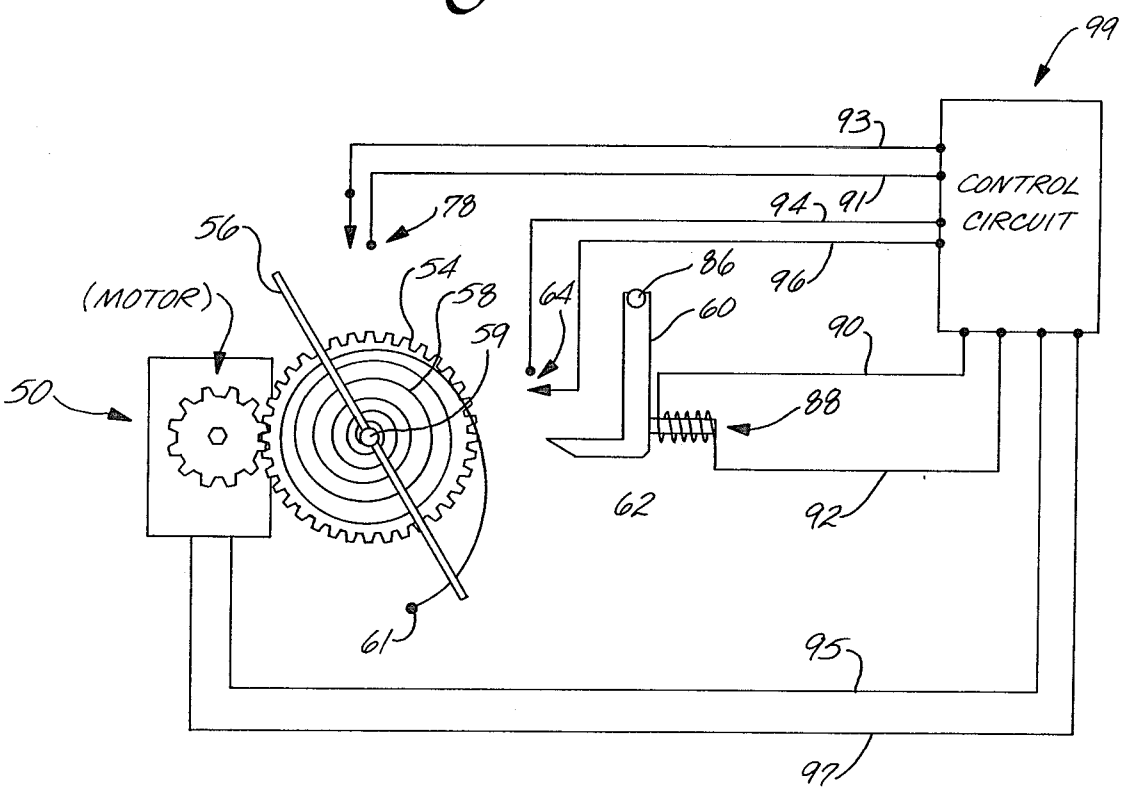
FIG. 4 illustrates a self-powered safety flue damper.

A drawing of a self-powered flue damper is shown in FIG. 4. In this embodiment, there is a motor 50 with a gear 52 mounted on its armature shaft, which meshes with a gear 54 mounted on the common shaft 59 of the flue damper plate 56. One end of a helical spring 58 is attached to the common shaft 59 and the other end is fixed to point 61 on the damper housing (not shown). The conductors 95 and 97 extend from the power input terminals of the motor 50 and connect to the control circuit 99. Also mounted on the housing is a locking lever 60 which can rotate about a pivot 86 on one end. Connected to the other end of the locking lever 60 is an armature 62 sliding within a solenoid coil 88 with conductors 90 and 92 connecting the soleniod coil 88 with the control circuit 99. Also mounted on the housing is a normally open switch 64 with conductors 94 and 96 connecting the switch 64 with the control circuit. The lever 60 and switch 64 are mounted so that when the damper plate 56 rotates to the closed position it presses on the switch 64 which causes closure of the contacts and is held in the closed position (horizontal in FIG. 4) by the hooking action of locking lever 60. A switch 78 with conductors 91 and 93 connecting it to the control circuit 99 is also mounted on the housing in such a way that the contacts are closed by the edge of the flue damper plate 56 when it rotates to the fully open position. Operation is as follows:

Assume that the flue damper is closed and held in that position by the action of the locking lever 60. A torque is stored in the helical spring 58 by the action of the previous close of the damper plate 56. If damper opening is required, the coil 88 is briefly energized by the control circuit 99. The coil 88 exerts a magnetic force upon the armature 62 which causes the locking lever 60 to rotate about the point 86. This releases the damper plate 56 which rotates to the open position driven by the stored torque of the helical spring 58. There is sufficient torque stored in the helical spring to rotate the damper plate 56 against the friction of the gear train formed by the gears 54 and 52 and the motor 50. If a less forecful spring is desired, an electrically controlled clutch may be employed to eliminate the effect of the gear train and motor friction. When the damper plate 56 reaches the fully open position, it presses upon a second normally open switch 78, closing its contacts. This contact closure is detected by the control circuit 99 which then continues with the lighting cycle. After burning is completed, the motor 50 is energized by the control circuit 99, and, acting through the gears 52 and 54, rotates the damper plate 56 back to the closed position where it again presses upon the switch 64 and becomes held again by the locking lever 60. Power to the motor is removed when the control circuit 99 detects the closure of the switch contacts 64. The control circuit 99 includes the valve control functions of the control circuit 210 previously described. Power for the motor 56 and solenoid 88 comes frodm the same rechargeable battery used for the valves and ignitor as described earlier.

Figure 5:
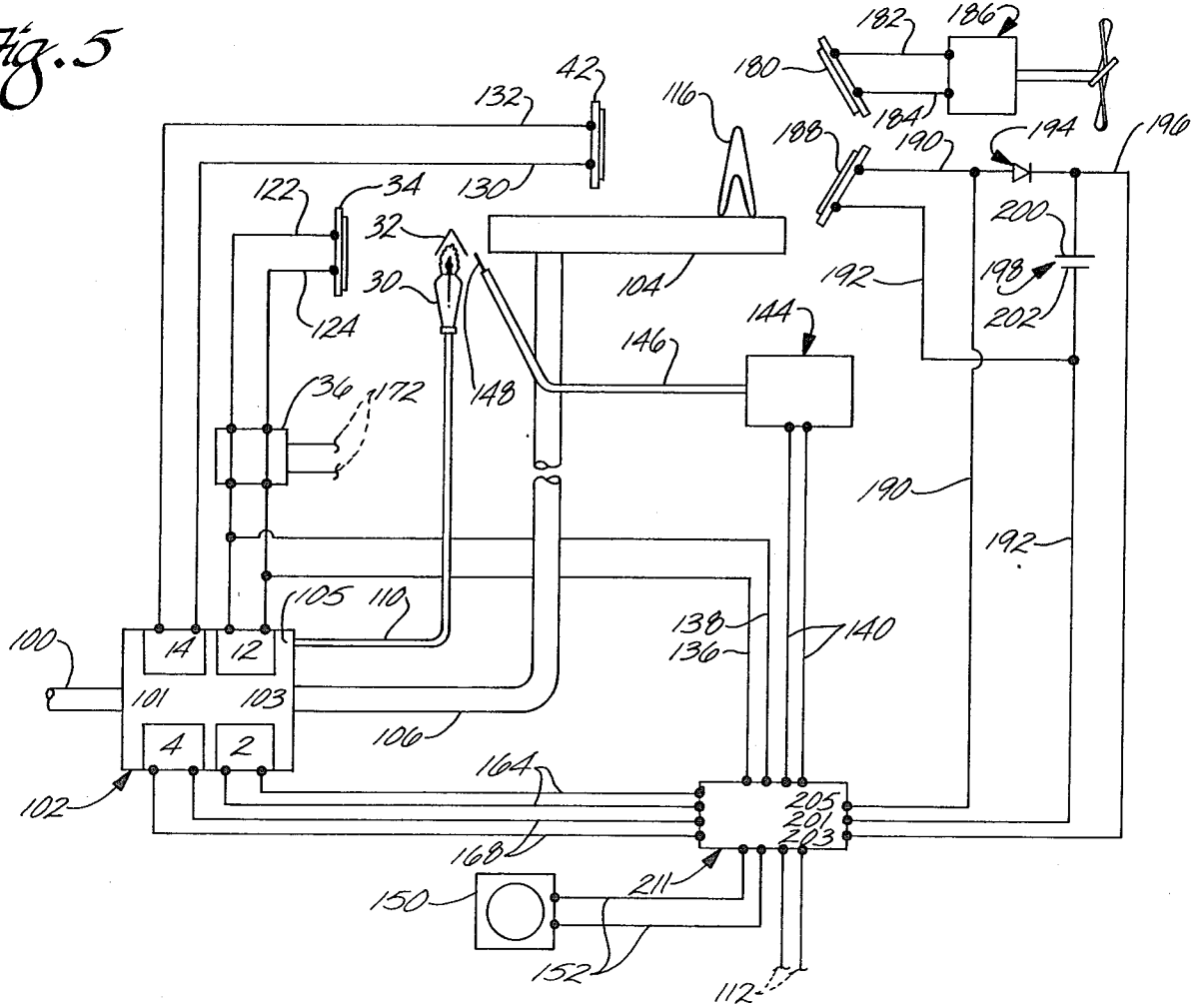
FIG. 5 illustrates schematically a comprehensive self-powered control system for a combustion appliance.

FIG. 5 is a schematic drawing of a completely sell-powered system as applied to a combustion appliance. In FIG. 5, a fuel supply pipe 100 is connected to the input side 101 of a two stage fuel gas valve 102. The Main burner output 103 of fuel gas valve 102 is connected to the main burner 104 via a main burner pipe 106. A pilot burner output 105 of the fuel gas valve 102 is connected to the pilot burner 30 via a pilot burner pipe 110. Mounted on the pilot burner 30 is an emissive element 32. Mounted on the main burner 104 is an emissive element 116. Mounted near and facing the emissive element 32 is a photovoltaic array 34, which is connected via the conductors 122 and 124 to a shutoff switch 36 and then to a first stage latching safety magnet 12 of the fuel gas valve 102. Mounted near and facing the emissive element 116 in the main burner flame is a photovoltaic array 42, which is connected via the conductors 130 and 132 to the second stage latching safety magnet 14 of the gas valve 102. One output of the control circuit 211 is connected via the conductors 140 to the input of a conventional spark ignition circuit 144. The output of the spark ignitor 144 is connected via high voltage cable 146 to a spark electrode 148 located near the pilot 30. Also placed facing the main burner emissive element 116 are photovoltaics 180 and 188. The positive conductor 190 of one photovoltaic device 188 is connected both to the anode of diode 194, and to an input terminal 205 of the control circuit 211. The negative conductor 192 of the photovoltaic device 188 is connected both to the negative terminal 202 of a battery 198 and to an input terminal 201 of the control circuit 211. The cathode of diode 194 is connected via a conductor 196 to the positive terminal 200 of the battery 198 and to an input terminal 203 of the control circuit 211. The control circuit 211 is connected via the conductors 164 to the first stage solenoid 2 and via conductors 168 to the second stage solenoid 4 of the gas valve 102. The control circuit 211 is also connected via the conductors 172 to the switch 36. The conductor 138 connects the photovoltaic conductor 122 to the control circuit 211. The conductor 136 connects the photovoltaic conductor 124 to the control circuit 211. The conductors 152 connect the thermostat 150 to the control circuit 211. The other photovoltaic device 180 is connected via the conductors 182 and 184 to an air circulating fan motor 186.

The system works in the following way: The thermostat 150 calls for heat by connecting conductors 152 together. The control circuit 211 responds by obtaining power from the battery 198 via the conductors 192 and 196 and presenting it via the conductors 168 to the first stage solenoid 2 of the gas valve 102. The first stage (not shown) of the gas valve 102 opens and admits gas to the pilot 30 via the gas pipe 110. At the same time, the control circuit 211 also connects the battery power to the input of spark ignitor circuit 144 via conductors 140. The high voltage pulses generated by the spark ignitor circuit 144 are conducted via the high voltage cable 146 to the spark electrode 148 where a spark occurs. As gas begins to flow from the pilot 30, it is ignited by the sparks. The resultant flame heats the emissive element 32 which begins to radiate. A portion of this radiation strikes the photovoltaic array 34, and the resultant electric power flows to the first stage latch 12 of the gas valve 102 via conductors 122 and 124. When the control circuit 211 detects the presence of the pilot flame by sensing the output of the photovoltaic device 34 via conductors 136 and 138, power is removed from the spark ignitor circuit 144 and from the solenoid 2. Since the latching magnet 12 is now energized by the current from the photovoltaic 34, the first stage of the gas valve 102 remains open and the pilot continues to burn. Battery power is now applied to the second stage solenoid 4 of the gas valve 102. This opens the second stage valve (not shown) and gas is allowed to pass to the main burner 104 where it is ignited by the pilot. A portion of the flame heats the main burner emissive element 116 which begins to radiate. A portion of that radiation strikes the photovoltaic array 188 and the resultant electric power flows via the conductors 190 and 192 through the isolating diode 194 to the battery 198 and to the control circuit 211. Another portion of the radiation strikes the photovoltaic array 42 and the electric power produced flows via conductors 130 and 132 to the second stage latch 14 of the gas valve 102. When the control circuit senses the output of the main burner photovoltaic array 188 via conductors 190 and 192, power is removed from the second stage solenoid 4. Since the second stage latch 14 is powered by the main burner photovoltaic 42, it also remains open and the main burner continues to operate. Since the valve solenoids are now disconnected and the spark ignitor is turned off, the full output of the main burner photovoltaic array 188 is available to recharge the battery 198. If the emissive element 116 is a high output quantum stimulated emitter, then an additional photovoltaic array 180 may be employed also facing the emissive element 116. The resultant radiation is converted by the photovoltaic array 180 to electric power which flows via conductors 182 and 184 to the fan motor 186 of the air circulation system. If the thermostat no longer calls for heat, control circuit 211 briefly turns on the input of the electronic switch 36 via the conductors 172. This causes the output of the electronic switch to assume a low impedance which bypasses the current flowing to the first stage latch 12 which causes the electromagnetic latch to be released, shutting off the flow of gas, and turning off the burner and pilot.

Thus a complete self-powered system has been described which meets and all requirements of a modern energy efficient control system for gas combustion appliances without the need for external power supplies.

DISCLOSURE DOCUMENTS INCLUDED

1. Self-powered flue damper, #149806, May 5, 1986
2. Self-powered intermittent ignition and control system, #152096, June 23, 1986
3. Photovoltaic controls with electrically powered emissive ignition devices, #135523, Mar. 1, 1985
4. Double latched valve, #152134, June 23, 1986
5. Self-Powered Intermittent Ignition and Control System for Gas Combustion Appliances #155370, Aug. 29, 1986.

What is claimed is:

1. A self-powered control system for a gas-fired appliance having a pilot burner and a main burner comprising:

first and second normally closed electromagnetic latching valves in series between a source of fuel gas and the main burner;

a gas connection to the pilot burner between the first and second valves;

an emissive surface in the flame of the pilot burner;

a photovoltaic device for irradiation from the emissive surface;

means coupling the photovoltaic device to the first valve for unlatching the first valve when the photovoltaic device is not irradiated by the emissive surface;

means for unlatching the second valve when the main burner is not burning; and means for successively opening the first and second valves.

2. A control system as recited in claim 1 wherein the first latching valve is latched open by current from the photovoltaic device and the latching is released when such current is discontinued.

3. A control system as recited in claim 1 comprising a second emissive surface in the flame of the main burner and a second photovoltaic device for irradiation from the second emissive surface, the second photovoltaic device being connected to the second latching valve so that current from the photovoltaic device maintains the second latching valve in its open position.

4. A control system as recited in claim 1 comprising a thermopile in the flame of the main burner and connected to the second latching valve so that current from the photovoltaic device maintains the second latching valve in its open position.

5. A control system as recited in claim 1 wherein the means for opening the first and second valves comprises a double acting solenoid for sequentially opening and latching the first valve, and thereafter opening and latching the second valve.

6. A control system as recited in claim 1 comprising a rechargeable battery and means for recharging the battery with energy from a flame in the gas-fired appliance.

7. A control system as recited in claim 6 wherein the means for recharging comprises an emissive surface in the main burner flame, and a photovoltaic device for irradiation from the emissive surface and connected to the battery.

8. A control system as recited in claim 1 further comprising:

a spring biased, normally open flue damper;

means for selectively closing the flue damper and latching it in the closed position;

means for releasing the latching; and means for enabling at least the main burner when the flue damper is in its open position.

9. A control system as recited in claim 8 wherein the means for enabling comprises a normally open switch closed by the flue damper when the flue damper is in its open position, the switch being connected to the valves for disabling at least the main burner when the flue damper is closed.

10. A self-powered control system for a gas-fired appliance having a pilot burner and a main burner comprising;

a two-stage valve comprising:

an inlet for connection to a source of fuel gas;

a normally closed first stage valve on the gas inlet;

a main outlet for connection to the main burner of a gas-fired appliance;

a normally closed second stage valve between the first stage valve and the main gas outlet;

a pilot outlet between the first and second stage valves for connection to the pilot burner of the gas-fired appliance;

means for opening the first stage valve and electromagnetically latching the first stage valve in the open position;

means for opening the second stage valve and electromagnetically latching the second stage valve in the open position;

an emissive surface for heating by the flame of the pilot burner;

a photovoltaic device exposed to radiation from the emissive surface, the output of the photovoltaic device being connected to the means for electromagnetically latching the first stage valve for maintaining the first stage valve open when the photovoltaic device is irradiated from the emissive surface and releasing the first stage valve for closing when the photovoltaic device is not irradiated; and means in the flame of the mainburner and coupled to the means for electromagnetically latching the second stage valve for maintaining the second stage valve open when the main burner is burning and releasing the second stage valve for closing when the main burner is not burning.

11. A control system as recited in claim 10 wherein the means for maintaining the second stage valve open comprises a second emissive surface for heating by the flame of the main burner and a second photovoltaic device exposed to radiation from the second emissive surface, the output of the second photovoltaic device being connected to the means for electromagnetically latching the second stage valve for maintaining the second stage valve open when the second photovoltaic device is irradiated from the second emissive surface and releasing the second stage valve for closing when the photovoltaic device is not irradiated.

12. A control system as recited in claim 10 wherein the means for maintaining the second stage valve open comprises a thermopile for heating by the flame of the main burner, the output of the thermopile being connected to the means for electromagnetically latching the second stage valve for maintaining the second stage valve open when the thermopile is heated and releasing the second stage valve for closing when the thermopile is not heated.

* * * * *